US010422171B2

(12) United States Patent
Lizotte

(10) Patent No.: US 10,422,171 B2
(45) Date of Patent: Sep. 24, 2019

(54) HINGE MECHANISM

(71) Applicant: ROUSSEAU MÉTAL INC., Saint-Jean-Port-Koli (CA)

(72) Inventor: Gerry Lizotte, Saint-Agapit (CA)

(73) Assignee: ROUSSEAU MÉTAL INC., Saint-Jean-Port-Joli, Quebec (CA)

( * ) Notice: Subject to any disclaimer, the term of this patent is extended or adjusted under 35 U.S.C. 154(b) by 57 days.

(21) Appl. No.: 15/514,122

(22) PCT Filed: Sep. 28, 2015

(86) PCT No.: PCT/CA2015/050971
§ 371 (c)(1),
(2) Date: Mar. 24, 2017

(87) PCT Pub. No.: WO2016/044955
PCT Pub. Date: Mar. 31, 2016

(65) Prior Publication Data

US 2017/0362866 A1 Dec. 21, 2017

(30) Foreign Application Priority Data

Sep. 26, 2014 (CA) ..... 2865345

(51) Int. Cl.
*E05D 7/12* (2006.01)
*E05D 7/04* (2006.01)
*E05D 3/02* (2006.01)

(52) U.S. Cl.
CPC ..... *E05D 7/04* (2013.01); *E05D 3/02* (2013.01); *E05D 2007/0469* (2013.01); *E05Y 2900/20* (2013.01)

(58) Field of Classification Search
CPC ..... Y10T 16/5321; Y10T 16/5322; Y10T 16/53225; Y10T 16/53253;
(Continued)

(56) References Cited

U.S. PATENT DOCUMENTS 2,583,950 A * 1/1952 Kirschner ..... E05D 7/0423 16/238
2,839,778 A * 6/1958 Hutchinson ..... E05D 7/0423 16/245
(Continued)

OTHER PUBLICATIONS

International Search Report and Written Opinion of the International Searching Authority for corresponding International Patent Application No. PCT/CA2015/050971 dated Feb. 3, 2016, 8 pgs.

*Primary Examiner* — Chuck Y Mah
(74) *Attorney, Agent, or Firm* — Merchant & Gould P.C.

(57) ABSTRACT

An adjustable hinge mechanism provides a hinging movement between first and second objects. The hinge mechanism includes a supporting component having a main body being operatively mountable onto the first object. The hinge mechanism also includes an intermediate component having a main body being operatively mountable onto the first object and being moveable with respect to the supporting component along at least opposite first and second horizontal directions. The hinge mechanism also includes a swivelling component being operatively mountable onto both the intermediate component and the second object, and being operatively moveable with respect to the supporting component along at least opposite first and second vertical directions.

18 Claims, 17 Drawing Sheets

(58) Field of Classification Search
CPC ... Y10T 16/53257; E05D 7/04; E05D 7/0423; E05D 7/0415; E05D 7/043; E05D 2007/0438; E05D 2007/0446; E05D 2017/0453; E05D 2017/0461; E05D 2017/0476; E05D 2017/0484; E05D 2017/0492; E05Y 2900/20
See application file for complete search history.

(56) References Cited

U.S. PATENT DOCUMENTS 4,091,502 A 5/1978 Little
4,730,364 A 3/1988 Tat-Kee
5,074,075 A 12/1991 La See
5,713,105 A * 2/1998 Toomey ..... E05D 7/0423 16/238
5,755,011 A * 5/1998 Green ..... E05D 7/0027 16/238
5,799,370 A * 9/1998 Davidian ..... E05D 7/0415 16/236
6,178,598 B1 1/2001 Creely, III et al.
6,516,494 B2 * 2/2003 Nakamoto ..... E05D 7/0027 16/236
6,715,181 B1 * 4/2004 Fries ..... E05D 7/0415 16/240
7,346,959 B2 * 3/2008 Heid ..... E05D 7/0027 16/242
7,552,511 B2 * 6/2009 Campbell ..... E05D 7/0423 16/236
7,653,967 B2 2/2010 Lowe
8,079,114 B2 * 12/2011 Fries ..... E05D 7/02 16/235
9,038,242 B2 * 5/2015 Chung ..... E05D 7/0415 16/240
2002/0073509 A1 6/2002 Dean
2006/0179610 A1 * 8/2006 Erickson ..... E05D 7/0423 16/243
2007/0143959 A1 * 6/2007 Chung ..... E05D 7/0423 16/236
2008/0104798 A1 * 5/2008 Hoppe ..... E05D 7/0027 16/236
2008/0271290 A1 * 11/2008 Chen ..... E05D 7/04 16/238
2008/0307606 A1 * 12/2008 Karlsson ..... E05D 7/0415 16/243
2009/0077767 A1 * 3/2009 Alchin ..... E05D 5/06 16/237
2010/0242227 A1 * 9/2010 Tagtow ..... E05D 7/0423 16/237
2012/0102674 A1 * 5/2012 King ..... E05D 7/0027 16/237
2015/0135480 A1 * 5/2015 Bartels ..... E05D 3/022 16/237

* cited by examiner

HINGE MECHANISM

This application is a National Stage Application of PCT/CA2015/050971, filed 28 Sep. 2015, which claims benefit of Serial No. 2,865,345, filed 26 Sep. 2014, in Canada and which applications are incorporated herein by reference. To the extent appropriate, a claim of priority is made to each of the above disclosed applications.

FIELD OF THE INVENTION

The present invention relates to a hinge mechanism. More particularly, and according to a possible embodiment, the present invention relates to an adjustable hinge mechanism, to an object (ex. a cabinet) provided with such a hinge mechanism, to a kit with corresponding components for assembling the same, and to corresponding methods of assembling and/or operating associated thereto.

BACKGROUND

Hinges are well known in the art. For example, FIGS. 1 to 5 illustrate conventional hinge mechanisms.

As illustrated in FIG. 1, certain storage cabinets are sometimes provided with steel doors. These doors are often provided with hinges which are generally manufactured from sheets of steel which are punched and rolled, as represented in FIGS. 2 and 3.

These types of hinges are generally welded onto the door. Afterwards, a powder paint coating is applied for the finish. However, certain considerable problems result when using these types of hinge mechanisms.

For example, when the paint is applied to the hinges, a uniform coat of paint is formed and covers the surface of the rollers enabling the paint to find itself at the junction of these rollers. During the baking of the paint, a continuous and resistant film is formed over the junction of the rollers and thus prevents a proper functioning of the hinge. One must then force the hinge in order to break the paint, which sometimes causes an undesirable chipping of the paint.

Another problem arises from the fact that the doors can be quite heavy. In the case of large doors with small heights, the door has a tendency to be brought down which causes friction in the bottom of the door on the side opposite to the hinges. It is very difficult to correct this problem given that there are generally no adjustment mechanisms that are possible with these types of hinges.

Finally, depending on the accessories that are found on top or under the doors, this may cause important "looseness" or "play" which does not give a nice overall appearance to the cabinet. In the case of actual hinge systems, this play must be tolerated because there are generally no adjustment mechanisms that are possible with these actual hinges.

There exists presently on the market hinges that enable to mitigate some of these problems by installing them after the paint and carrying out the necessary adjustments to the door, such as illustrated in FIGS. 4 and 5. However, these hinges are generally quite expensive, and are not sufficient robust for steel doors, and their mounting plates are generally poorly adapted and are also quite cumbersome.

Also known in the art are other disadvantageous and inconveniences associated with such conventional systems, namely the fact they cannot be used in a very easy, efficient and/or versatile manner for different applications.

Thus, it would be particularly useful to be able to provide an improved system or mechanism which, by virtue of its design and components, would be able to overcome or at least minimize some of the aforementioned drawbacks of the prior art associated with conventional systems.

SUMMARY OF THE INVENTION

An object of the present invention is to provide a hinge mechanism which, by virtue of its design and components, satisfies some of the above-mentioned need(s) and which is thus an improvement over other related hinge mechanisms and/or methods known in the prior art.

In accordance with the present invention, the above object is achieved, as will be easily understood from the present description, with a hinge system (also referred to herein as a "hinge mechanism") such as the one briefly described herein and such as the one exemplified in the accompanying drawings.

More particularly, according to one aspect of the present invention, there is provided an adjustable hinge mechanism for providing a hinging movement between first and second objects, the hinge mechanism comprising:

a supporting component having a main body being operatively mountable onto the first object;

an intermediate component having a main body being operatively mountable onto the first object and being moveable with respect to the supporting component along at least opposite first and second horizontal directions; and a swivelling component being operatively mountable onto both the intermediate component and the second object, and being operatively moveable with respect to the supporting component along at least opposite first and second vertical directions.

According to another aspect of the present invention, there is provided a door assembly provided with the above-mentioned hinge system and/or mechanism.

According to another aspect of the present invention, there is provided a storage container (ex. a cabinet) provided with the above-mentioned hinge system, mechanism, and/or door assembly.

According to another aspect of the invention, there is also provided a method of assembling and/or mounting the above-mentioned hinge system and/or mechanism onto a corresponding door assembly and/or storage container.

According to yet another aspect of the invention, there is also provided a method of using the above-mentioned hinge system, mechanism, door assembly and/or storage container.

According to yet another aspect of the invention, there is also provided a kit with components for assembling the above-mentioned hinge system, mechanism, door assembly and/or storage container.

According to yet another aspect of the present invention, there is also provided a set of components for interchanging with components of the above-mentioned kit.

According to yet another aspect of the present invention, there is also provided a method of assembling components of the above-mentioned kit and/or set.

According to yet another aspect of the present invention, there is also provided a method of doing business with the above-mentioned hinge system, mechanism, door assembly, storage container, components thereof, kit, set and/or method(s).

The objects, advantages, and other features of the present invention will become more apparent upon reading of the following non-restrictive description of preferred embodiments thereof, given for the purpose of exemplification only, with reference to the accompanying drawings.

BRIEF DESCRIPTION OF THE ACCOMPANYING DRAWINGS

DETAILED DESCRIPTION OF POSSIBLE EMBODIMENTS OF THE INVENTION

Figure 1:
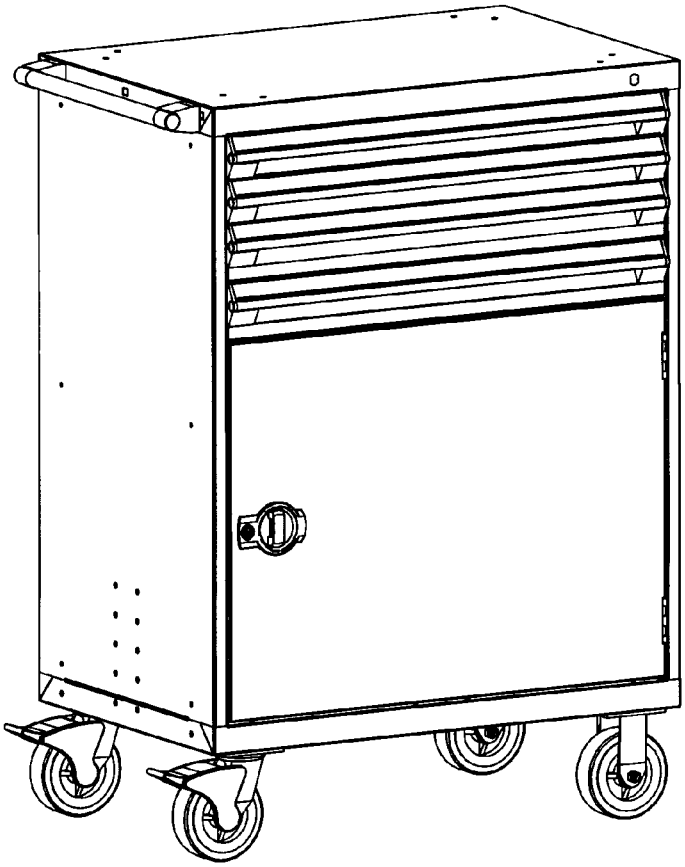
FIG. 1 (PRIOR ART)
FIG. 1 is a perspective view of a storage container having a door assembly provided with at least one hinge mechanism according to the prior art.
Figure 2:
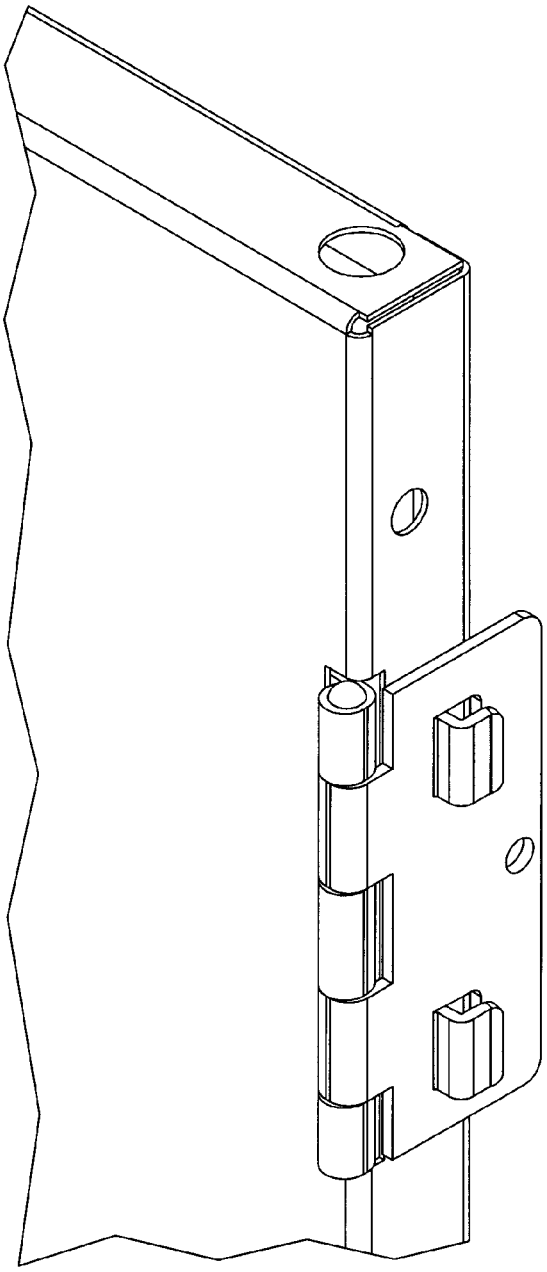
FIG. 2 (PRIOR ART)
FIG. 2 is a partial perspective view of a storage container and/or a door assembly provided with a hinge mechanism according to the prior art.
Figure 3:
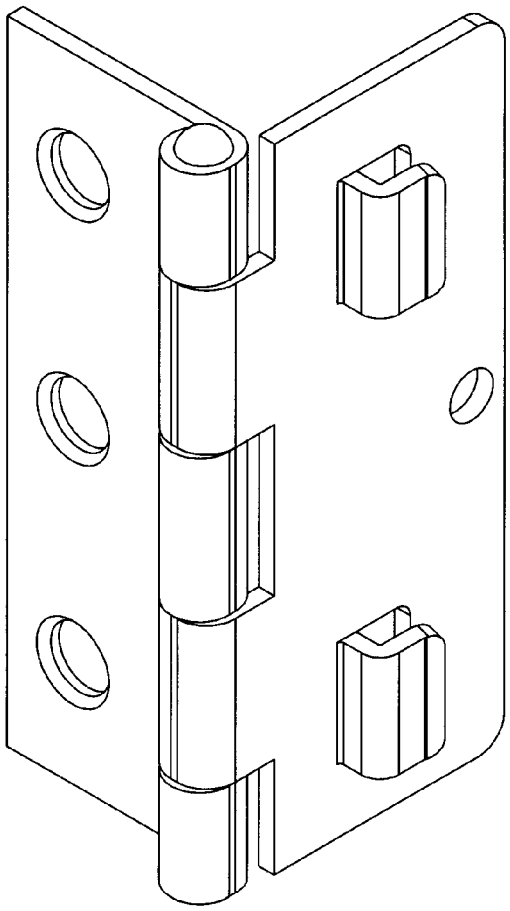
FIG. 3 (PRIOR ART)
FIG. 3 is a perspective view of the hinge mechanism shown in FIG. 2, the hinge mechanism being shown in a possible open configuration.
Figure 4:
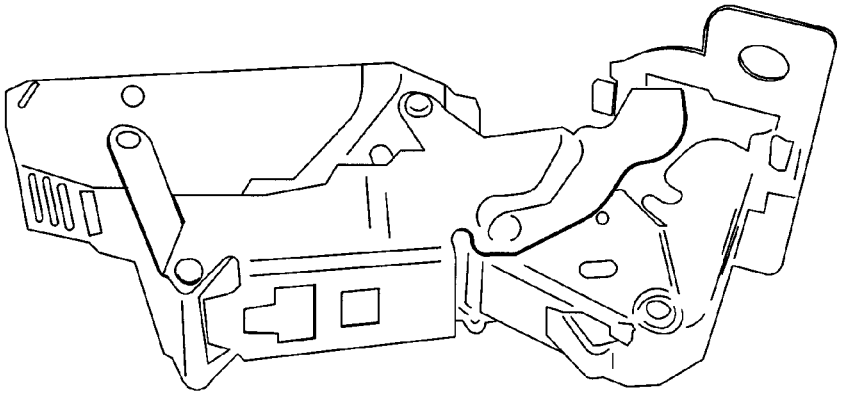
FIG. 4 (PRIOR ART)
FIG. 4 is a partial perspective view of a storage container having a door assembly being shown in an intermediate open configuration and provided with a hinge mechanism according to the prior art.
Figure 5:
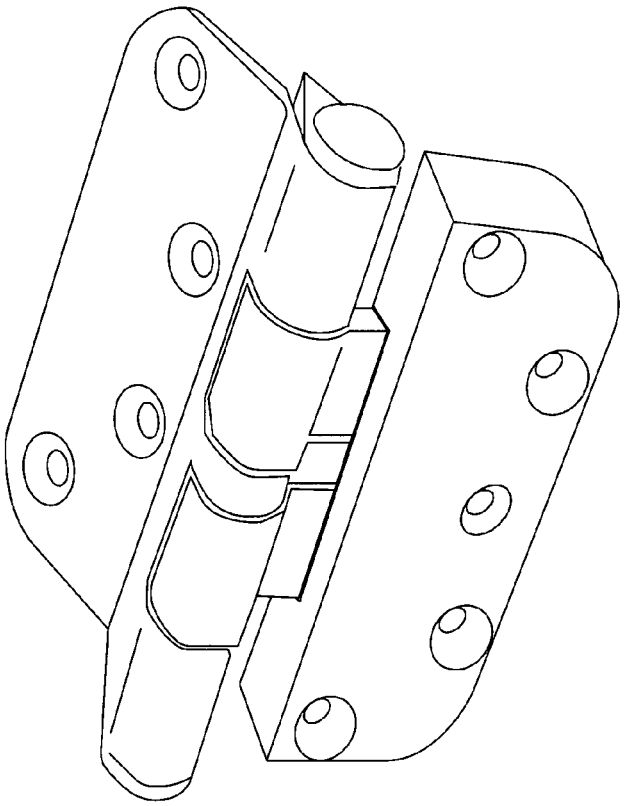
FIG. 5 (PRIOR ART)
FIG. 5 is a perspective view of a hinge mechanism according to the prior art, the hinge mechanism being shown in a possible open configuration.

In the following description, the same numerical references refer to similar elements. Furthermore, for sake of simplicity and clarity, namely so as to not unduly burden the figures with several reference numbers, only some figures have been provided with reference numbers, and components and features of the present invention illustrated in other figures can be easily inferred therefrom. The embodiments, geometrical configurations, materials mentioned and/or dimensions shown in the figures are preferred, for exemplification purposes only.

Moreover, although the present invention was primarily designed for use with a storage space or container, such as a cabinet and/or the like, for example, it may be used with other objects and/or in other types of applications, as apparent to a person skilled in the art. For this reason, expressions such as "storage", "closed", "substantially closed", "space", "area", "container", "box", "cabinet", etc., used herein should not be taken so as to limit the scope of the present invention and include all other kinds of objects (ex. access doors for people, etc.) and/or applications (ex. relative movement and/or displacement and/or adjustment required between two objects and/or surfaces, etc.) with which the present invention could be used and may be useful.

Moreover, in the context of the present invention, the expressions "hinge", "system", "mechanism", "device", "apparatus", "product", "unit", "equipment", "assembly", "tool", "method" and "kit", as well as any other equivalent expressions and/or compounds word thereof known in the art will be used interchangeably, as apparent to a person skilled in the art. This applies also for any other mutually equivalent expressions, such as, for example: a) "first degree-of-freedom", "first path", "horizontal axis", "horizontal direction(s)", "first translational axis", "first mutually orthogonal axis", etc.; b) "second degree-of-freedom", "second path", "vertical axis", "vertical direction(s)", "second translational axis", "second mutually orthogonal axis", etc.; c) "third degree-of-freedom", "third path", "transversal axis", "transversal direction(s)", "third translational axis", "third mutually orthogonal axis", etc.; d) "connected", "secured", "mounted", "fastened", "attached", "riveted", "interconnected", "interlocked", etc.; e) "hinge", "pivot", "rotation", "axis", etc.; f) "moveable", "displaceable", "adjustable", "sliding", "gliding", "rotating", "skidding", "relatively", etc.; g) "track", "rail", "guide", "path", etc.; h) "securing", "restraining", "affixing", "holding", "fastening", "adjusting", etc.; i) "cavity", "recess", "hole", "groove", "slot", "slit", "notch", etc.; j) "fastener", "connector", "rivet", "clip", "lock", "interconnect", "interlock", "press-fit", etc.; as well as for any other mutually equivalent expressions, pertaining to the aforementioned expressions and/or to any other structural and/or functional aspects of the present invention, as also apparent to a person skilled in the art.

Furthermore, in the context of the present description, it will be considered that all elongated objects will have an implicit "longitudinal axis" or "centerline", such as the longitudinal axis of shaft for example, or the centerline of a coiled spring, for example, and that expressions such as "connected" and "connectable", or "mounted" and "mountable", may be interchangeable, in that the present invention also relates to a kit with corresponding components for assembling a resulting fully-assembled and operational hinge system and/or mechanism (and/or door assembly and/or storage container, such as a cabinet for example, including the same, etc.).

Moreover, components of the present system(s) and/or steps of the method(s) described herein could be modified, simplified, altered, omitted and/or interchanged, without departing from the scope of the present invention, depending on the particular applications which the present invention is intended for, and the desired end results, as briefly exemplified herein and as also apparent to a person skilled in the art.

In addition, although the preferred embodiments of the present invention as illustrated in the accompanying drawings comprise various components, and although the preferred embodiments of the hinge mechanism and corresponding parts as shown consist of certain geometrical configurations, as explained and illustrated herein, not all of these components and geometries are essential to the invention and thus should not be taken in their restrictive sense, i.e. should not be taken so as to limit the scope of the present invention. It is to be understood, as also apparent to a person skilled in the art, that other suitable components and cooperation thereinbetween, as well as other suitable geometrical configurations may be used for the hinge mechanism and corresponding parts according to the present invention, as will be briefly explained herein and as can be easily inferred herefrom by a person skilled in the art, without departing from the scope of the present invention.

LIST OF NUMERICAL REFERENCES FOR SOME OF THE CORRESPONDING POSSIBLE COMPONENTS ILLUSTRATED IN THE ACCOMPANYING DRAWINGS

1. hinge mechanism
3. first object (ex. main body of a cabinet)
5. second object (ex. door of a cabinet)
7. supporting component (of hinge mechanism)
7*a*. first lateral side (of supporting component)
7*b*. second lateral side (of supporting component)
7*c*. frontal side (of supporting component)
7*d*. rearward side (of supporting component)
9. intermediate component (of hinge mechanism)
11. swivelling component (of hinge mechanism)
13. cavity (of first object)
15. mounting wall (of supporting component)
15*a*. first mounting wall (of supporting component)
15*b*. second mounting wall (of supporting component)
17. receiving wall (of first object)
17*a*. first receiving wall (of first object)
17*b*. second receiving wall (of first object)
19. connecting component (of supporting component)
21. tightening fastener
23. orifice (for tightening fastener)
23*a*. first distal end (of orifice)
23*b*. second distal end (of orifice)
25. groove (for bolt used on supporting component)
27. frontal passage (of supporting component)
29. hole (of supporting component)
31. rivet
33. rearward connecting component (of supporting component)
35. adjustment fastener (of supporting component)
37. structural reinforcement component (of supporting component)
39. side slot (of supporting component)
41. bore (of intermediate component)
43. recessed portion (of inlet of bore)
45. hinging portion
45*a*. first distal hinging portion
45*b*. second distal hinging portion
45*c*. central hinging portion
47. pivot rod
49. mounting plate (of swivelling)
51. hooking component (of mounting plate)
53. pivoting component
55. eccentrically-mounted pin (of pivoting component)
57. recess (for mounting plate)
59. abutment component (of swivelling component)
61. adjustment plate (of swivelling component)
63. positioning fastener (of swivelling component)
63*a*. upper positioning fastener
63*b*. lower positioning fastener
63*c*. central positioning fastener
65. orifice (of swivelling component)
67. connecting component (of swivelling component)
69. recess (for adjustment plate)
71. groove (for bolt used on swivelling component)
73. slot (of adjustment plate)
75. complementary cavity (of main body of swivelling component)
77. orifice (on mounting plate for securing fastener)
79. securing fastener Broadly described, and as better exemplified in the accompanying drawings, the present invention relates to a hinge system and/or mechanism (1) intended to provide a "hinge movement" (i.e. hinging, pivoting, rotating, swivelling, relative movement and/or displacement and/or adjustment, etc.) between first and second objects requiring such a hinge movement, as is the case of a door with respect to a corresponding main body of a storage container (ex. a cabinet and/or the like, etc.), for example, and the present system is intended to do so in a simpler, easier, faster, more cost-effective and/or more reliable manner, than what is possible with other conventional hinge mechanisms.

The present hinge system and/or mechanism (1) may come in various shapes and/or forms, and may include one and/or several of the following components and features (and/or different combination(s) thereof, etc.).

In accordance with one possible aspect of the present system, there is provided an adjustable hinge mechanism (1) for providing a hinging movement between first and second objects (3,5), the hinge mechanism (1) comprising: a supporting component (7) having a main body being operatively mountable onto the first object (3); an intermediate component (9) having a main body being operatively mountable onto the first object (3) and being moveable with respect to the supporting component (7) along at least opposite first and second horizontal directions; and a swivelling component (11) being operatively mountable onto both the intermediate component (9) and the second object (5), and being operatively moveable with respect to the supporting component (7) along at least opposite first and second vertical directions.

Indeed, the present system is designed for allowing the hinge mechanism (1) to be adjustable, in a simpler, easier, faster, more cost-effective and/or more reliable manner, along various degrees-of-motion (ex. directions, etc.) between the first and second objects provided with the hinge mechanism (1).

Indeed, as will be explained in greater detail hereinbelow and as can be serially understood from the accompanying figures, the swivelling component (11) can be selectively adjustable with respect to the intermediate component (9), and/or the intermediate component (9) can be selectively adjustable with respect to the supporting component (7), for allowing the present hinge mechanism (1) to be selectively adjustable between the first and second objects (3,5), in order to selectively adjust the resulting hinging movement provided by said hinge mechanism (1).

According to one possible embodiment, the main body of the supporting component (7) can be a substantially U-shaped body, as better shown in FIGS. 6-9, for example, and may be insertable into a corresponding cavity (13) defined by the first object, as exemplified in FIGS. 10-15.

The main body of the supporting component (7) can comprise at least one mounting wall (15) configured for affixing onto a corresponding receiving wall (17) of the first object (3), but according to a preferred embodiment, the main body of the supporting component (7) comprises opposite first and second mounting walls (15*a*,15*b*) configured for affixing onto corresponding first and second receiving walls (17*a*,17*b*) respectively of the first object (3), as can be easily understood when referring to FIGS. 6-15.

As also shown, the supporting component (7) may comprise at least one connecting component (19) configured for receiving a corresponding tightening fastener (21) extendable through opposite walls and through the intermediate component (9), in order to clamp the intermediate component (9) between said opposite walls, thereby adjustably securing a horizontal positioning of said intermediate component (9) with respect to the supporting component (7).

Figure 7:
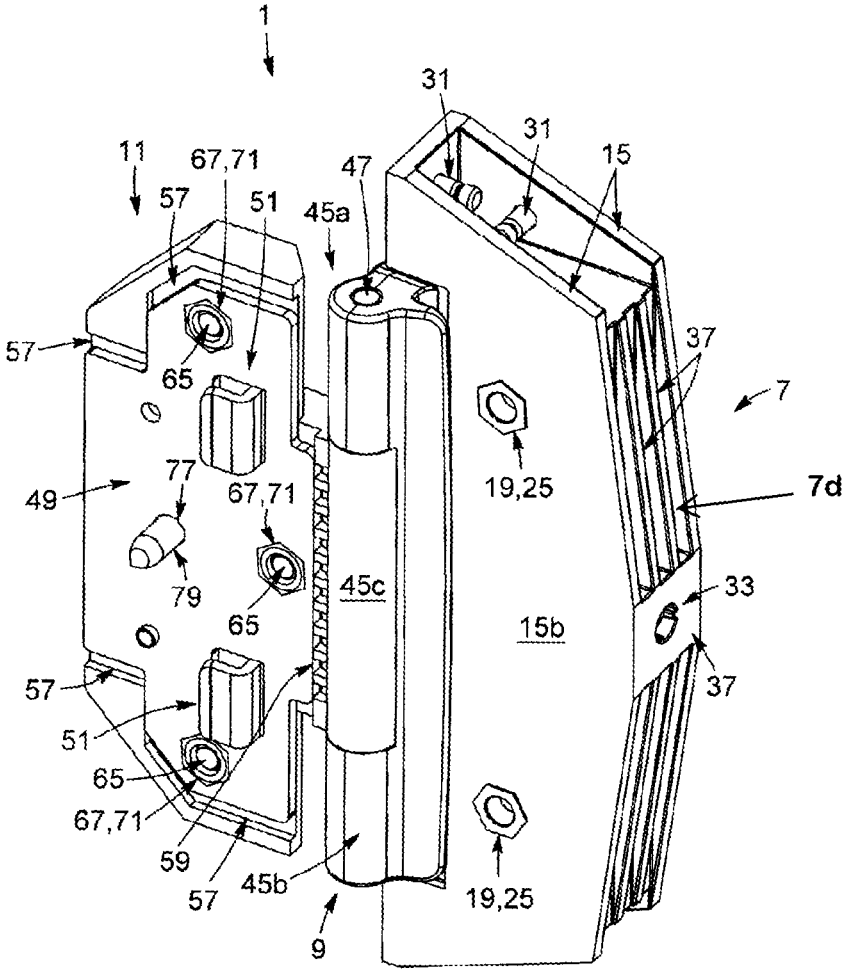
FIG. 7 is a rear perspective view of what is shown in FIG. 6.

The supporting component (7) may comprises at least one pair of connecting components (19), as better shown in FIG. 7, for example, and as can be easily understood from the remaining figures, for each connecting component (19) provided on one side of the main body of the supporting component (7), there can also be provided a corresponding orifice (23) on an opposite side of the supporting component (7), said orifice (23) being positioned, shaped and sized for receiving therein a corresponding tightening fastener (21).

Figure 8:
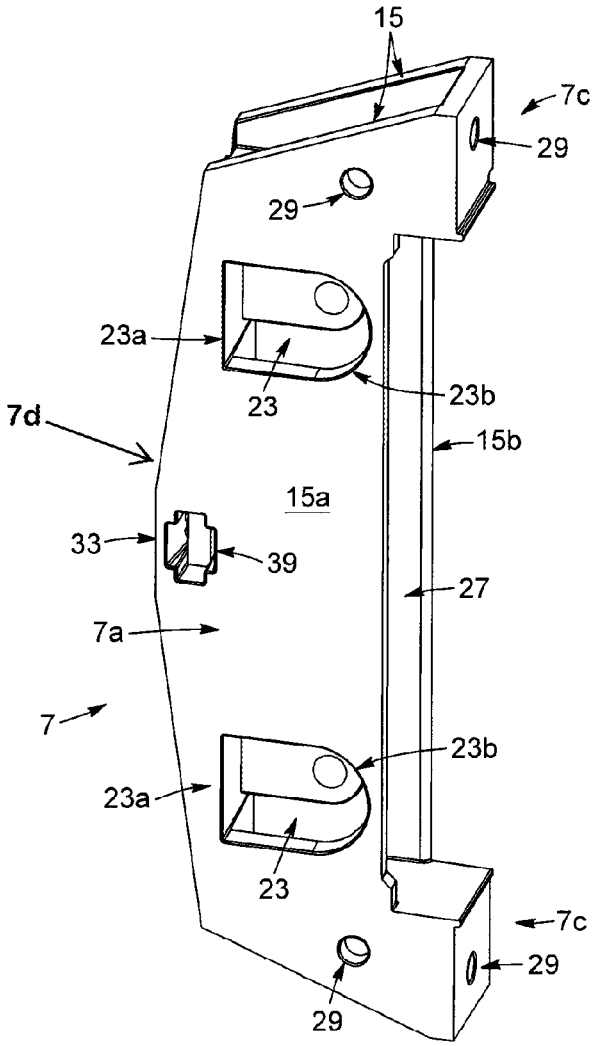
FIG. 8 is a perspective view of a supporting component of a hinge mechanism according to a possible embodiment of the present invention.

As better shown in FIG. 8, each orifice (23) of the supporting component (7) may be an elongated orifice (23), with opposite first and distal ends (23*a*,23*b*), and according to the embodiment exemplified, the orifice (23) is substantially rectilinear, with a square distal end (23*a*) and an opposite rounded distal end (23*b*), with each connecting component (19) of the supporting component (7) being provided on a same side of the main body of supporting component (7), although various other shapes and forms, as well as geometrical dispositions are contemplated for the supporting component (7) and corresponding portions thereof (ex. orifice(s), connecting component(s), etc.), depending on the desired end results intended with the present hinge mechanism (1), as can be easily understood.

Each connecting component (19) of the supporting component (7) may comprise a threading complementary to that of its corresponding tightening fastener (21), for ensuring a proper cooperation thereinbetween, and according to a possible embodiment of the present system, each connecting component (19) may simply consist of a threaded bolt being mountable onto a corresponding groove (25) of the supporting component (7). Various other suitable mechanical equivalents are also contemplated. For example, the connecting component(s) (19) and the supporting component (7) need not be separate components, but rather, the connecting component(s) (19) could be made "integral" to the supporting component (7), that is, made of essentially the same piece and/or of essentially the same material.

According to another possible feature of the present system, the main body of the supporting component (7) may comprise a frontal passage (27) being positioned, shaped and sized for allowing the intermediate component (9) to be inserted into the supporting component (7) via said frontal passage (27), as can be easily understood when referring to FIGS. 6-9. The front passage (27) may define a cut-out portion within the main body of the supporting component (7), and according to the embodiment illustrated in the drawings, the cut-out portion defined within the main body of the supporting component is substantially rectangular, as better shown in FIG. 9.

As also shown, the main body of the supporting component (7) may comprise at least one hole (29) configured for receiving a corresponding rivet (31) used for affixing the supporting component (7) to the first object (3), and the at least one hole (29) may provided on a lateral side (7*a*,7*b*) of the supporting component (7), and/or on a frontal side (7*c*) of the supporting component (7), and/or on any other suitable location of the supporting component (7). As can also be easily understood from the accompanying drawings, the first object (ex. main body of a cabinet, for example) may be provided with appropriate orifices for cooperating (i.e. receiving, aligning with, etc.) with the holes and/or fasteners of the hinge mechanism (1).

According to the possible embodiment exemplified in FIGS. 6-9, and as can be easily understood therefrom, the supporting component (7) may be provided with a rearward connecting component (33) configured for receiving a corresponding adjustment fastener (35) extendable through the intermediate component (9) and into the rearward connecting component (33), in order to selectively adjust a positioning of the intermediate component (9) with respect to the supporting component (7) along the opposite first and second horizontal directions via a corresponding rotation of said adjustment fastener (35).

The rearward connecting component (33) may be provided on a rearward side (7*d*) of the supporting component (7), as illustrated, although other suitable locations for the rearward connecting component (33) are also contemplated with the present system so long as they enable the intermediate component (9) to be displaced along the supporting component (7), and optionally also, the rearward side (7*d*) of the supporting component (7) may be operatively connected to at least one other side, whether one lateral side (7*a*), the other lateral side (7*b*) and/or both lateral sides (7*a*,7*b*) of the supporting component (7), via at least one structural reinforcement component (37), for providing the supporting component (7) with greater structural resistance to any loads it may be subject to.

Similarly to the above-mentioned when referring to the connecting component (19) of the supporting component (7), the rearward connecting component (33) may comprise a threading complementary to that of the adjustment fastener (35), for ensuring a proper cooperation thereinbetween (ex. displacement of the intermediate component (9) along the supporting component (7), etc.), and according to a possible embodiment of the present system, the rearward connecting component (33) may simply consist of a threaded bolt being mountable onto a corresponding portion of the supporting component (7), and the rearward connecting component (33) may be accessible via a corresponding side slot (39) of the supporting component (7). As also mentioned earlier, various other suitable mechanical equivalents are also contemplated. For example, the rearward connecting component(s) (33) and the supporting component (7) need not be separate components, but rather, the rearward connecting component(s) (33) could be made "integral" to the supporting component (7), that is, made of essentially the same piece and/or of essentially the same material.

As can easily understood from FIGS. 6-15, the main body of the intermediate component (9) may comprise a bore (41) being positioned, shaped and sized for receiving the adjustment fastener (35), and an inlet of the bore (41) may comprise a recessed portion (43) for receiving a corresponding head of the adjustment fastener (35). Also, the main body of the intermediate component (9) is preferably shaped and sized for inserting into the main body of the supporting component (7).

The ways of interconnecting the swivelling component (11) to the supporting component (7) via the intermediate component (9) can be varied. For example, the intermediate component (9) may define a female hinging portion configured for receiving a corresponding male hinging portion of the swivelling component (11). Alternatively, the swivelling component (11) may define a female hinging portion configured for receiving a corresponding male hinging portion of the intermediate component (9). The female hinging portion may be defined between a pair of distal hinging portions (45*a*,45*b*) of one component (ex. the intermediate component (9), as illustrated in the accompanying drawings) of the hinge mechanism (1) and may be further configured for receiving a central hinging portion (45*c*) of another component (ex. swivelling component (11), as also illustrated in the accompanying drawings) of the hinge mechanism (1). As can be easily understood from FIGS. 6-15, the hinging portions (45*a*,45*b*,45*c*) can be connectable to one another via a pivot rod (47) insertable through said hinging portions (45*a*,45*b*,45*c*), whether it be a common pivot rod (47) or a plurality of rods aligned along a same pivoting (i.e. "hinging") axis.

According to a possible embodiment of the present system, the swivelling component (11) comprises a mounting plate (49) configured for operatively mounting the swivelling component (11) onto the second object (5) via said mounting plate (49). The mounting plate (49) may be provided with at least one hooking component (51) for hooking the mounting plate (49) and associated swivelling component (11) onto the second object (5) via said mounting plate (49).

As can be easily understood from the accompanying drawings, the mounting plate (49) is preferably configured for an adjustable mounting and positioning onto a main body of the swivelling component (11), and is operatively moveable with respect to said main body of the swivelling component (11) for allowing a positional adjustment of the first object (3) with respect of the second object (5) via the hinge mechanism (1).

Figure 16:
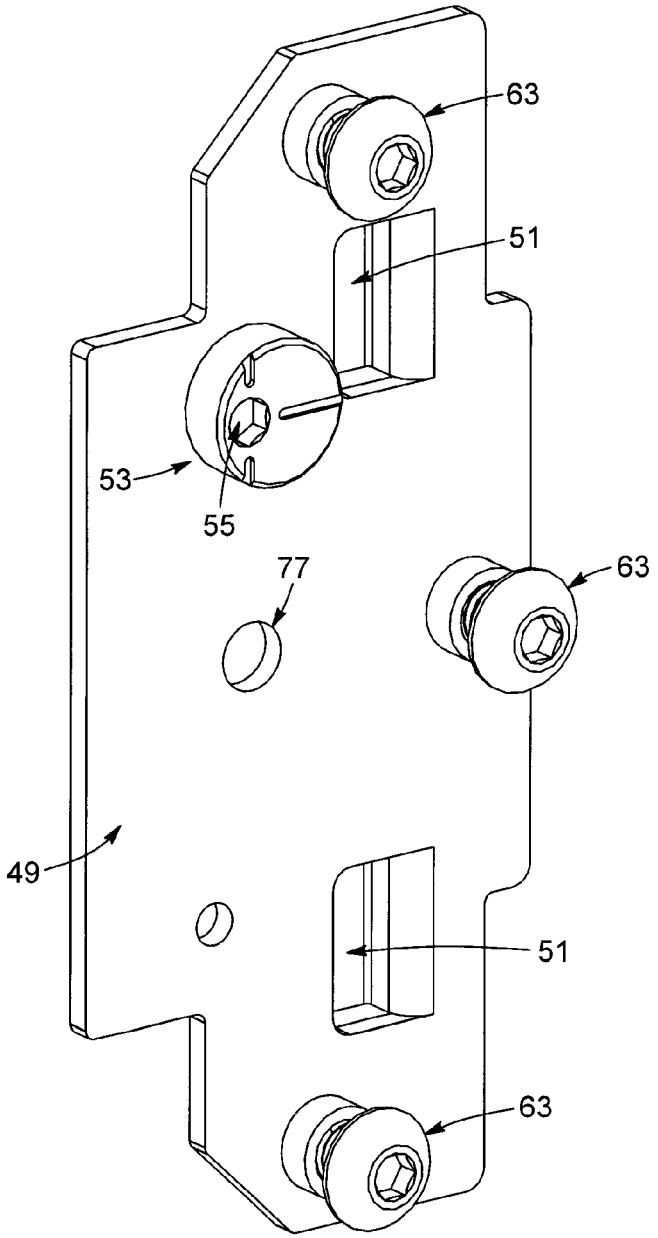
FIG. 16 is a perspective view of a mounting plate provided with a pivoting component and with a plurality of positioning fasteners according to a possible embodiment of the present invention.
Figure 17:
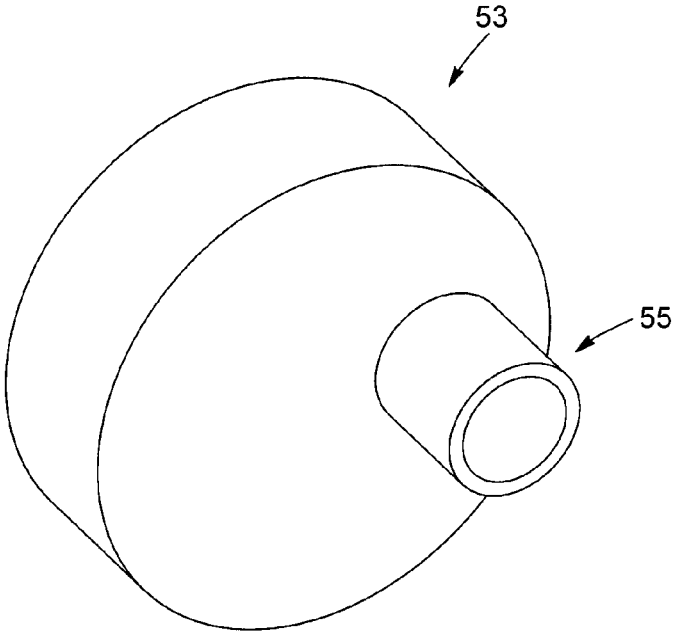
FIG. 17 is a perspective view of the pivoting component of FIG. 16, this view better illustrating an eccentrically-mounted pin of the pivoting component according to a possible embodiment of the present invention.

A vertical positional adjustment of the mounting plate (49) with respect to the main body of the swivelling component (11) can done via a rotation of a pivoting component (53) being operatively mounted onto the main body of the swivelling component (11) and having an eccentrically mounted pin (55) cooperating with the mounting plate (49), for example, as better shown in FIGS. 16 and 17.

Figure 14:
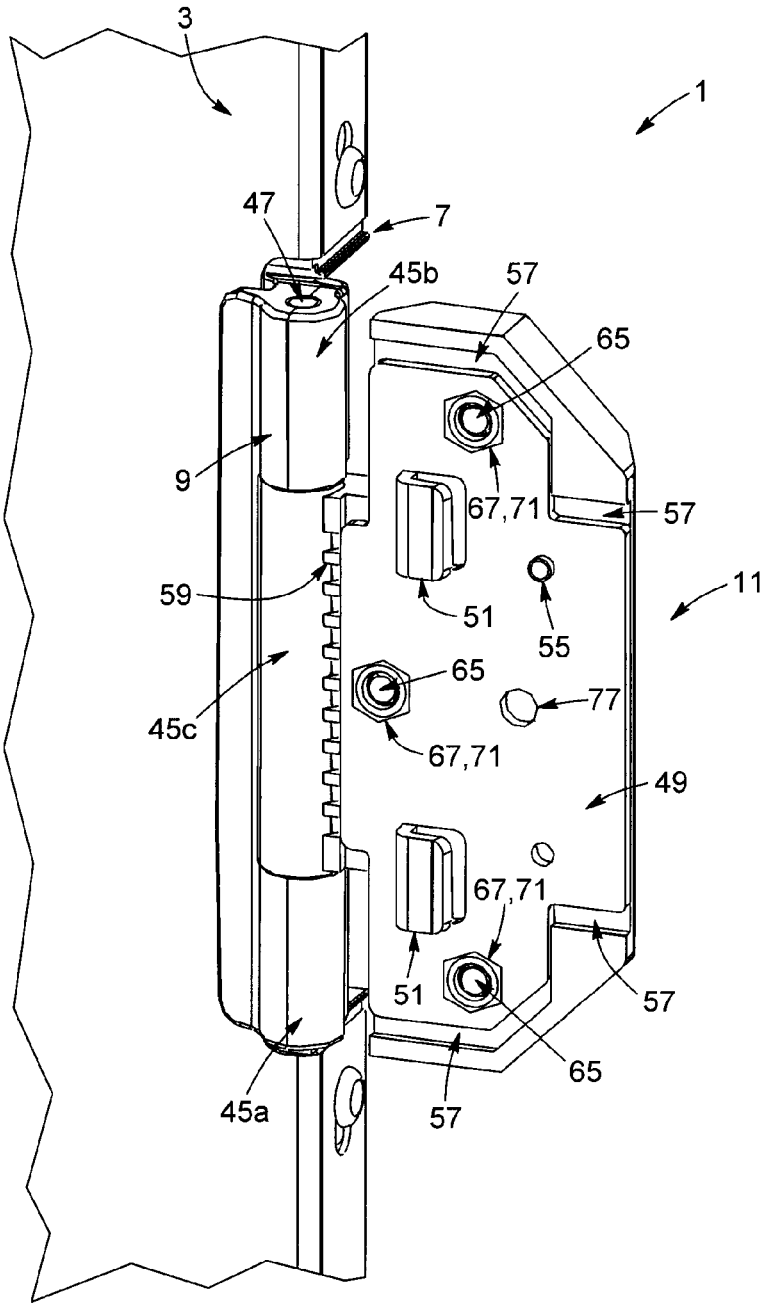
FIG. 14 is an opposite perspective view of what is shown in FIG. 13.

Optionally also, the mounting plate (49) is adjustably movable within a corresponding recess (57) defined about the main body of the swivelling component (11), as better shown in FIG. 14. A side of the recess (57) defined about the main body of the swivelling component (11) may be provided with at least one abutting component (59) for abutting against the mounting plate.

Figure 15:
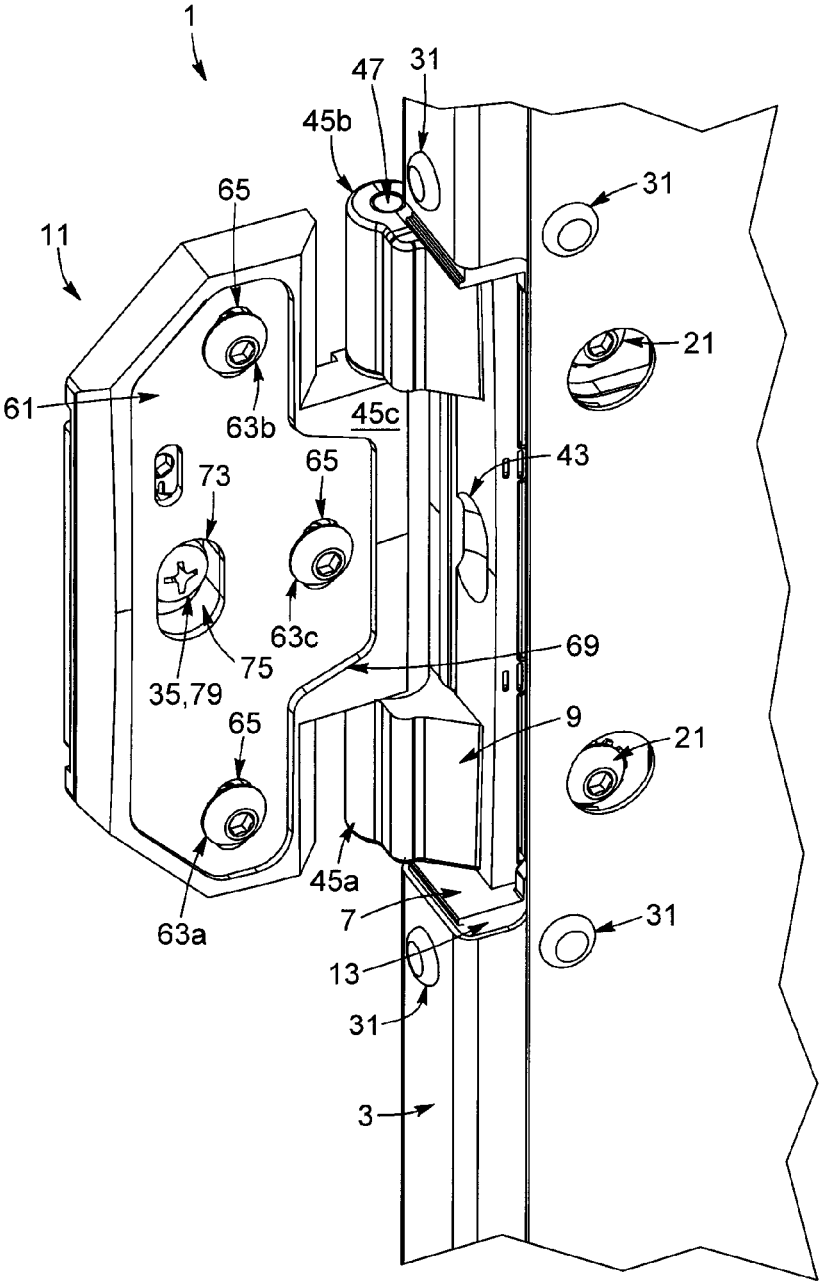
FIG. 15 is another perspective view of what is shown in FIG. 13, the swivelling component being shown in another intermediate open configuration and being provided with a securing fastener according to a possible embodiment of the present invention.

As can be easily understood when contrasting FIGS. 14 and 15, for example, the mounting plate (49) can be located on one side of the main body of the swivelling component (11), and can be operatively connectable to an adjustment plate (61) on an opposite side of the main body of the swivelling component (11) via at least one positioning fastener (63). Similarly to the above-discussed with respect to the mounting plate (49), the adjustment plate (61) can be adjustably movable within a corresponding recess (69) defined about the main body of the swivelling component (11), as better shown in FIG. 13 or 15. The at least one positioning fastener (63) may comprise at least two positioning fasteners (63) (ex. a pair of distally opposite fasteners (63)) insertable into corresponding orifices (65) of the main body of the swivelling component (11). As exemplified in the accompanying drawings, the at least one positioning fastener (63) may comprise at least three positioning fasteners (63), a first positioning fastener (63*a*) being insertable into a corresponding upper orifice (65*a*) of the main body of the swivelling component (11), a second positioning fastener (63*b*) being insertable into a corresponding lower orifice (65*b*) of the main body of the swivelling component (11), and a third positioning fastener (63*c*) being insertable into a corresponding central orifice (65*c*) of the of the main body of the swivelling component (11).

According to a possible embodiment of the present system, a plate (ex. the mounting plate (49)) of the swivelling component (11) may be provided with at least one connecting component (67) for receiving therein a corresponding positioning fastener (63), with each connecting component (67) of the swivelling component (11) being provided on a same side of the main body of swivelling component (11).

Similarly to the above-mentioned when referring to the connecting component (19) of the supporting component (7), each connecting component (67) of the swivelling component (11) may comprises a threading complementary to that of its corresponding positioning fastener (63), for ensuring a proper cooperation thereinbetween, and according to a possible embodiment of the present system, each connecting component (67) of the swivelling component (11) may simply consist of a threaded bolt being mountable onto a corresponding groove (71) of the swivelling component (11). As also mentioned earlier, various other suitable mechanical equivalents are also contemplated. For example, each connecting component(s) (67) and the swivelling component (11) need not be separate components, but rather, the connecting component(s) (67) could be made "integral" to the swivelling component (11), that is, made of essentially the same piece and/or of essentially the same material.

According to other optional features of the present system, another plate (ex. the adjustment plate (61)) of the swivelling component (11) can be provided with a corresponding orifice (65) for each orifice (65) provided on the main body of the swivelling component (11), and each orifice (65) of the swivelling component (11) may be an oblong orifice (65), as can be easily understood from the accompanying drawings.

As also shown, the adjustment plate (61) may comprise a slot (73) for allowing space for a corresponding head of an adjustment fastener (35) of the hinge mechanism (1) when the hinge mechanism (1) is operated in a closed configuration, and the main body of the swivelling component (11) may comprise a complementary cavity (75) adjacent to the slot (73) of the adjustment plate (61) for further allowing space for the head of the adjustment fastener (35) of the hinge mechanism (1) when the hinge mechanism (1) is operated in the closed configuration.

The mounting plate (49) may also comprise an orifice (77) adjacent to the complementary cavity (75) of the main body of the swivelling component (11) for receiving a corresponding securing fastener (79), such as, for example, for securing positioning of the second object (5) with respect to the swivelling component (11) when a corresponding adjustment has been done with the hinge mechanism (1), etc.

As can be easily understood from the enclosed figures, the first object (3) may include (and/or may be part of) a main body frame of a storage space (ex. cabinet) and the second object (7) may include (and/or may be part of) a door of said storage space, and according to another aspect of the present invention, there is also provided a cabinet having a door being moveable with respect to a main body, the cabinet being provided with at least one hinge mechanism such as the one briefly described herein and such as the one exemplified in the accompanying drawings, given that the present system has been mainly designed for use with a storage space or container, such as a cabinet and/or the like, for example.

However, as previously explained, it may be used with other objects and/or in other types of applications, as apparent to a person skilled in the art. For this reason, expressions such as "storage", "closed", "substantially closed", "space", "area", "container", "box", "cabinet", etc., used herein should not be taken so as to limit the scope of the present invention and include all other kinds of objects and/or applications with which the present invention could be used and may be useful.

According to another aspect of the present invention, there is also provided a kit with corresponding for assembling a hinge mechanism (1) such as the one briefly described herein and such as the one exemplified in the accompanying drawings.

As described hereinabove, and as illustrated in the accompanying drawings, the present system concerns a hinge mechanism (1) that can be connected to at least two surfaces and/or objects (3,5), these items being configured to be mounted in a removable manner and/or in a fixed manner with the hinge mechanism (1) in order to enable a relative movement between the two surfaces and/or objects (3,5).

Figure 6:
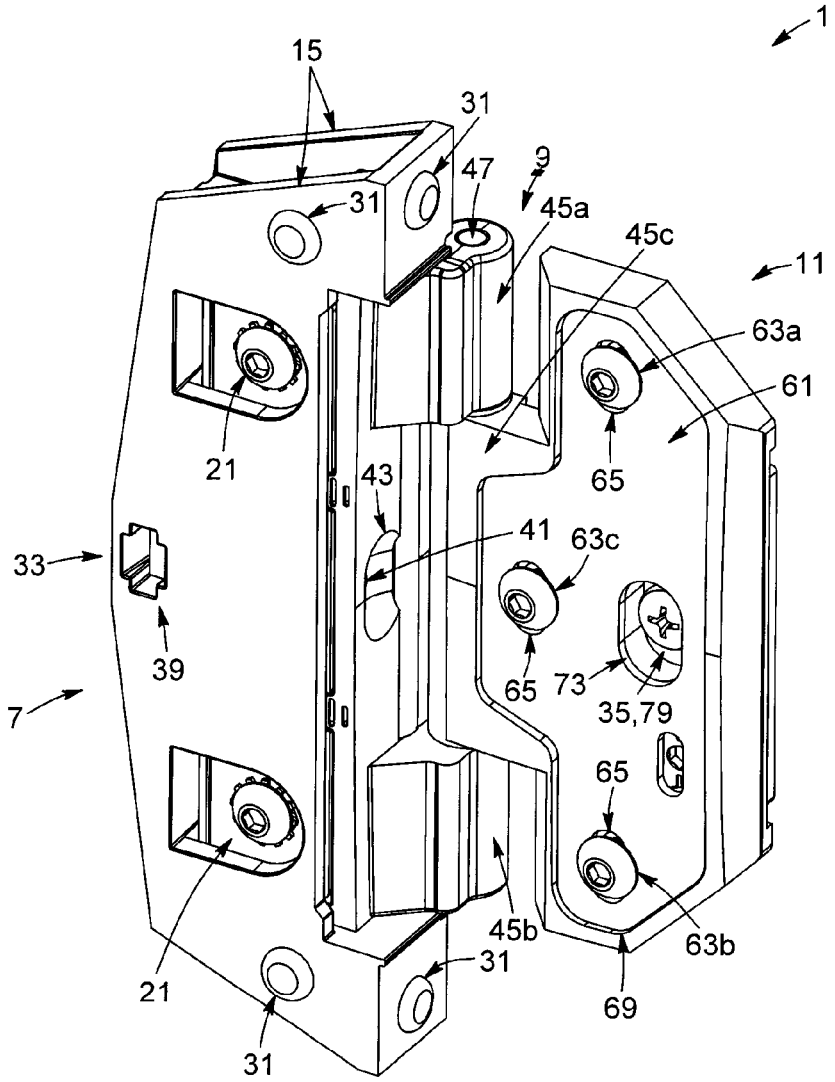
FIG. 6 is a front perspective view of a hinge mechanism according to a possible embodiment of the present invention, the hinge mechanism being shown in a possible open configuration.

The hinge system represented in FIG. 6 will be described once again, as way of a possible example, only, in the context of a swivelling door of a cabinet. Namely, a supporting component (7) is fixed onto the door by means of rivets, screws, clips, etc. Furthermore, a swivelling component (11), hereinafter referred to also as a "male half-hinge", is fixed onto the cabinet and/or any other object, by means of an adaptor with hooks. Moreover, an intermediate component (9), hereinafter referred to also as a "female half-hinge", is intended to serve as a pivot and acts as a link between the supporting component (7) and the male half-hinge.

Figure 11:
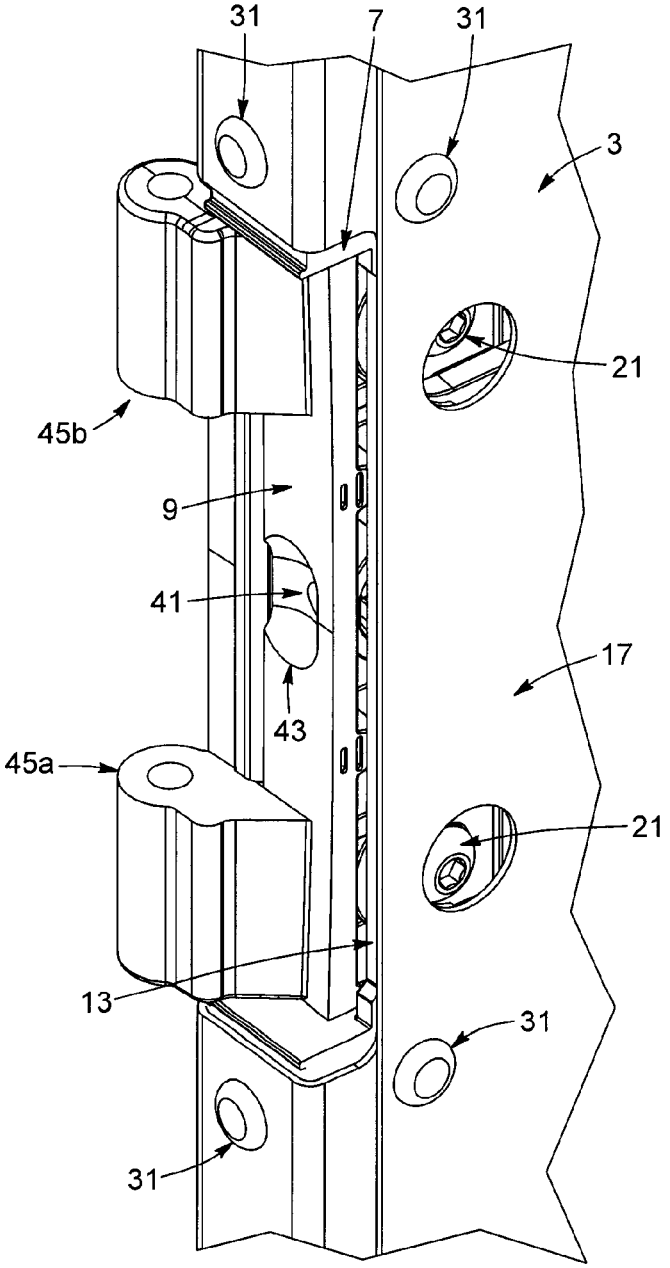
FIG. 11 is an enlarged perspective view of a portion of what is shown in FIG. 10, the supporting component being now shown provided with an intermediate component according to a possible embodiment of the present invention.

The female half-hinge is then inserted inside of the supporting component (7), as represented in FIG. 11. An adjustment screw (35) is then inserted into a bolt of the supporting component (7), which can be made of nylon and/or of any other suitable material, and enables to carry out easily the horizontal adjustment of the hinge mechanism (1). Once the adjustment has been carried out, it is possible to block the position of the female half-hinge by means of a tightening screw (21), as represented in FIG. 11. This adjustment is normally done once the door is completely installed onto the cabinet.

Figure 12:
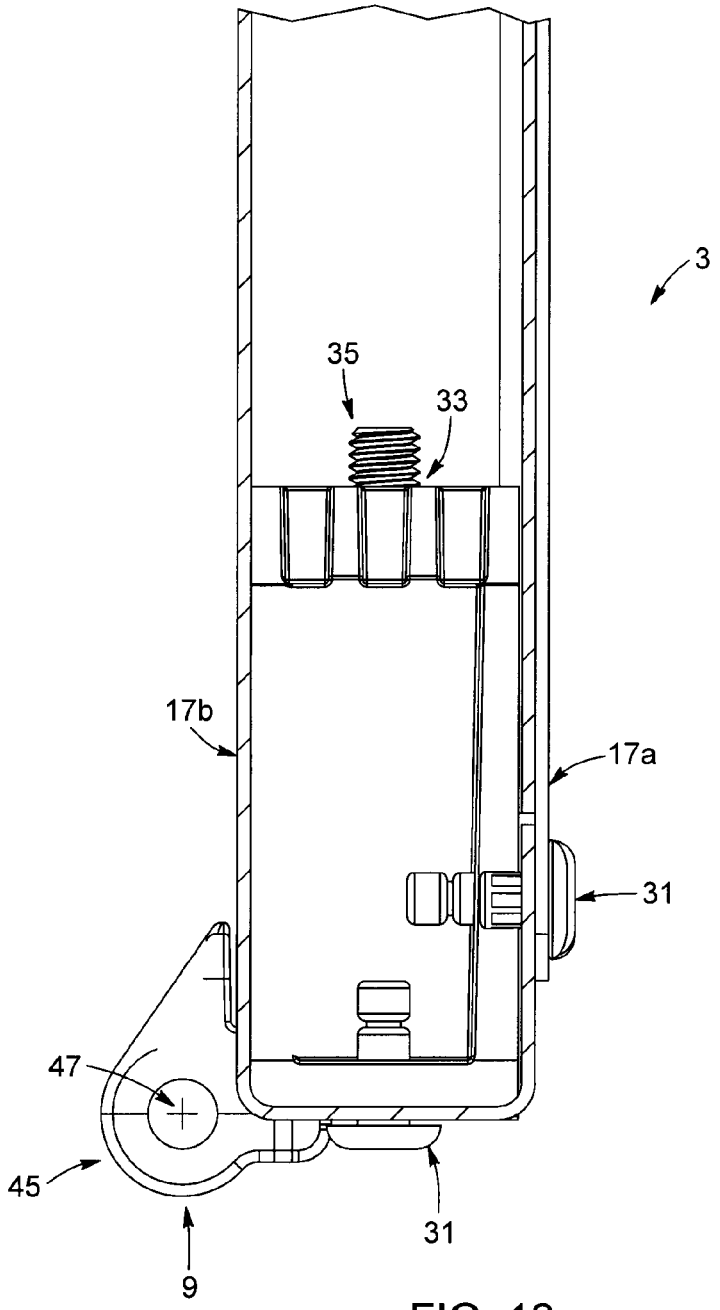
FIG. 12 is a top view of what is shown in FIG. 11.
Figure 13:
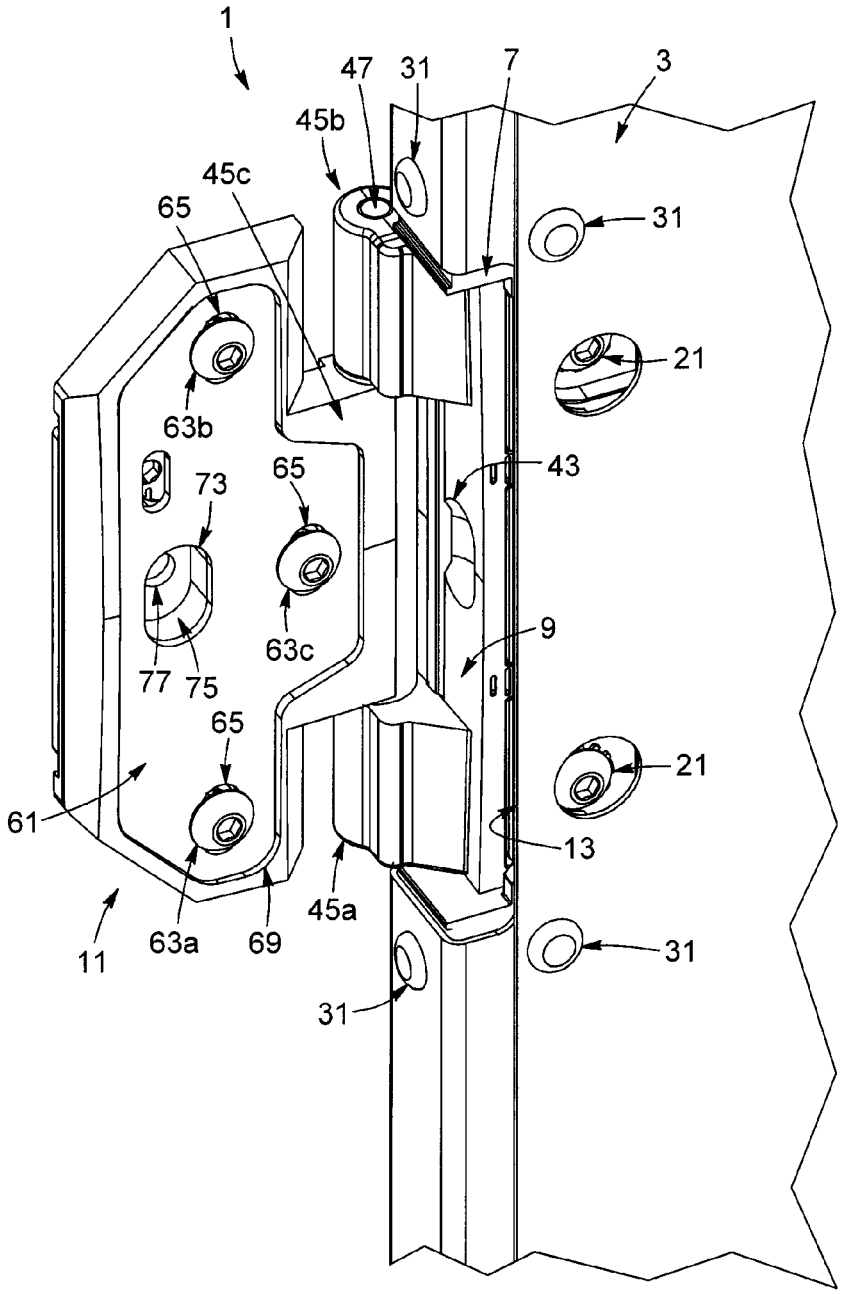
FIG. 13 is another perspective view of what is shown in FIG. 11, the intermediate component being now shown provided with a swivelling component in an open configuration according to a possible embodiment of the present invention.

The geometry of the visible part of the female half-hinge can be configured so as to embark over the front face of the door, as represented in FIG. 12. In this manner, when the horizontal adjustment of the hinge is completed, this portion of the female half-hinge remains always in front of the door and impedes the creation of a slit between the door and the hinge. This enables namely to improve the aesthetic of the finished product.

Figure 9:
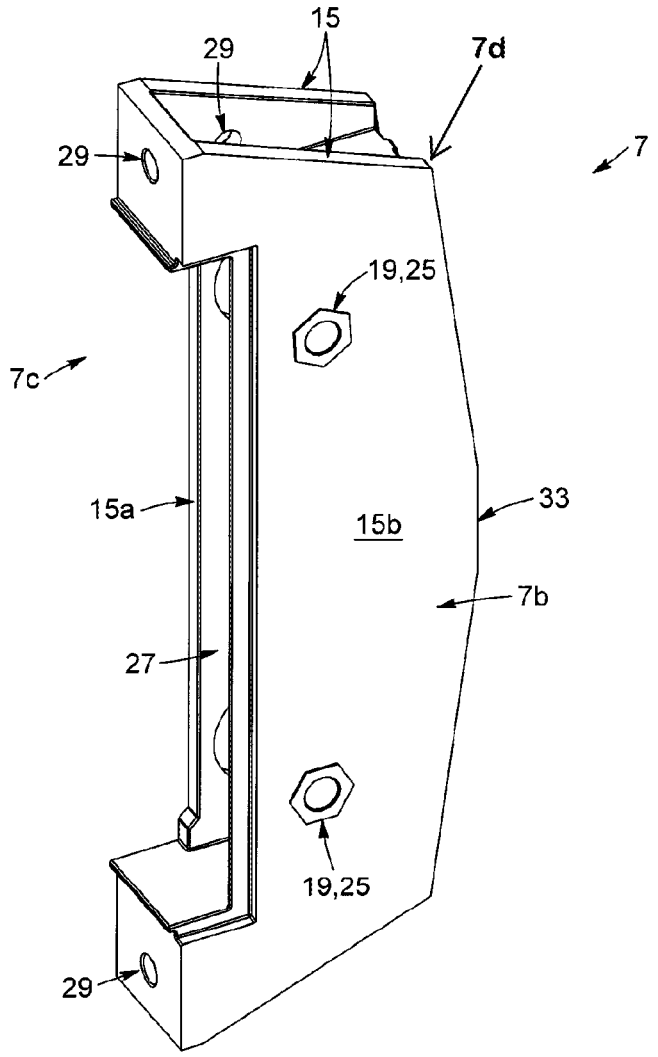
FIG. 9 is an opposite perspective view of what is shown in FIG. 8.
Figure 10:
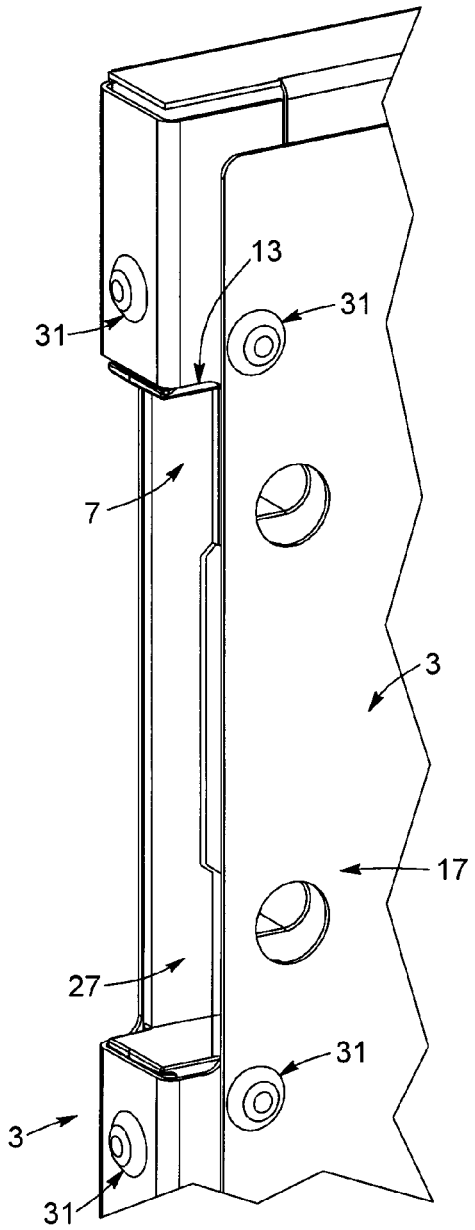
FIG. 10 is a partial perspective view of a first object (ex. main body of a storage cabinet) provided with a supporting component and corresponding fasteners of a hinge mechanism according to a possible embodiment of the present invention.

As represented in FIG. 9, the supporting component (7) can be provided with riveted bolts, these bolts being intended, for example, to receive the tightening screws (21) which will enable to block the position of the female half-hinge, as will be discussed in greater detail hereinbelow. The supporting component (7) can be provided with a cavity for receiving a nylon bolt (for example), or any appropriate mechanism. This nylon bolt can be used to receive an adjustment screw (21) of the female half-hinge. Finally, the supporting component (7) can be fixed to the door by means of rivets, and/or any other suitable fasteners and/or connectors, as can be easily understood from FIG. 10. The supporting component (7) can be made of plastic, aluminum casting and/or any other appropriate material. The nylon bolts can also be replaced by machine threading directly onto the supporting component (7) and/or by any other appropriate object. The supporting component (7) can be fixed to the door by other means then rivets, such as for example, by screws and/or by a clipping system, etc.

The male half-hinge can be fixed to the female half-hinge by means of a steel rod (47), and/or by a rod (47) made of any other suitable component/material. The rod (47) can be inserted under pressure (ex. press-fitted, force-fitted, etc.) and is intended to serve as a pivot axis to the hinge mechanism (1), as can be easily understood from FIG. 13.

As can be easily understood from FIG. 14, the male half-hinge can be fixed to the cabinet by means of a mounting plate (49), hereinafter referred to also as a "fixing plate", which could be made of steel and/or any other suitable material, etc. The geometry of this fixing plate can be variable depending on the conception of the cabinet on which the hinge mechanism (1) is meant to be installed. This enables namely to have a same hinge mechanism (1) that can be used for a multitude of different applications simply by modifying the fixing plate (ex. the mounting plate (49)) which acts as an "adapter". In the example illustrated, the fixing plate is provided with two hooks because it can be fixed onto a post with square perforations, for example. The hinge mechanism (1) could also be installed on other types of objects by replacing the hooks, for example, by holes for screws and/or by different hooks, for example. Depending on the design of the cabinet in which the hinge mechanism (1) is to be installed, one simply has to simply change (i.e. interchange, substitute, etc.) the fixing plate (ex. the mounting plate (49)). All of the other components of the hinge mechanism (1) can substantially remain the same.

As mentioned earlier, and according to a possible embodiment, the fixing plate is provided with an eccentric pivot (53) which can be pivoted onto the fixing plate and which enables to carry out a vertical adjustment of the hinge mechanism (1), as represented in FIGS. 16 and 17, by simply turning the pivot (53) by means of a screwdriver or any other appropriate object, the male half-hinge is displaced up and down, that is, in a substantially vertical manner, with respect to the fixing plate. Once the adjustment is completed, one can simply block the position of the male half-hinge by means of at least one securing screw (79), but preferably, by means of three securing screws (79), as shown.

Thus, in view of the above, and as may now be better appreciated, the present hinge system and/or mechanism (1) is advantageous over other related hinge devices and/or methods in that it enables to provide a "hinge movement" (i.e. hinging, pivoting, rotating, swivelling, relative movement and/or displacement and/or adjustment, etc.) between first and second objects requiring such a hinge movement, as is the case of a door with respect to a corresponding main body of a storage container (ex. a cabinet and/or the like, etc.), for example, in a much simpler, easier, faster, more convenient, more reliable and/or more versatile manner than what is possible with other conventional systems.

Finally, and as can be easily understood, the hinge system and/or mechanism (1) and corresponding parts can be made of substantially rigid materials, such as metallic materials, hardened polymers, composite materials, and/or the like, as well as other possible combinations thereof, depending on the particular applications for which the hinge system and/or mechanism (1) is intended for, and the desired end results.

Of course, and as can be easily understood by a person skilled in the art, the scope of the claims should not be limited by the possible embodiments set forth in the examples, but should be given the broadest interpretation consistent with the description as a whole.

The invention claimed is:

1. An adjustable hinge mechanism for providing a hinging movement between first and second objects, the hinge mechanism comprising:

a supporting component having a main body being operatively mountable onto the first object;

an intermediate component having a main body being operatively mountable onto the first object and being rotatably connected with a pivot rod and moveable with respect to the supporting component along at least opposite first and second horizontal directions; wherein the supporting component comprises at least one connecting component configured for receiving a corresponding tightening fastener extendable through opposite walls of the connecting component and through the intermediate component, to clamp the intermediate component between said opposite walls, thereby adjustably securing horizontal positioning of said intermediate component with respect to the supporting component; and a swivelling component being operatively mountable onto both the intermediate component and the second object, and being operatively adjustable with respect to the supporting component along at least opposite first and second vertical directions.

2. A hinge mechanism according to claim 1, wherein the main body of the supporting component is a substantially U-shaped body; wherein the main body of the supporting component is insertable into a corresponding cavity defined by the first object; wherein the at least one mounting wall comprises at least one mounting wall configured for affixing onto a corresponding receiving wall of the first object; and wherein the main body of the supporting component comprises a first mounting wall and an opposite second mounting wall configured for affixing onto corresponding first and second receiving walls respectively of the first object.

3. A hinge mechanism according to claim 1, wherein for each connecting component provided on one side of the main body of the supporting component, there is also provided a corresponding orifice on an opposite side of the supporting component, said orifice being positioned, shaped and sized for receiving therein a corresponding tightening fastener.

4. A hinge mechanism according to claim 3, wherein the orifice is an elongated orifice; wherein the orifice comprises a first end and an opposite distal end; wherein the orifice is substantially rectilinear; wherein the orifice has a square distal end and a rounded distal end; wherein each connecting component of the supporting component is provided on a same side of the main body of the supporting component; wherein each connecting component of the supporting component comprises threading complementary to threading of a corresponding tightening fastener; and wherein each connecting component of the supporting component comprises a threaded bolt mountable onto a corresponding groove of the supporting component.

5. A hinge mechanism according to claim 1, wherein the main body of the supporting component comprises a frontal passage being positioned, shaped and sized for allowing the intermediate component to be inserted into the supporting component via said frontal passage.

6. A hinge mechanism according to claim 5, wherein the front passage defines a cut-out portion within the main body of the supporting component; and wherein the cut-out portion defined within the main body of the supporting component is substantially rectangular.

7. A hinge mechanism according to claim 1, wherein the main body of the supporting component comprises at least one hole configured for receiving a corresponding rivet used for affixing the supporting component to the first object.

8. A hinge mechanism according to claim 1, wherein the main body of the supporting component comprises at least one first hole provided on a lateral side of the supporting component; and wherein the main body of the supporting component comprises at least one second hole provided on a frontal side of the supporting component.

9. An adjustable hinge mechanism for providing a hinging movement between first and second objects, the hinge mechanism comprising:

a supporting component having a main body being operatively mountable onto the first object;

an intermediate component having a main body being operatively mountable onto the first object and being rotatably connected with a pivot rod and moveable with respect to the supporting component along at least opposite first and second horizontal directions; wherein the supporting component comprises at least one connecting component configured for receiving a corresponding tightening fastener extendable through opposite walls of the connecting component and through the intermediate component, to clamp the intermediate component between said opposite walls, thereby adjustably securing horizontal positioning of said intermediate component with respect to the supporting component; and a swivelling component being operatively mountable onto both the intermediate component and the second object, and being operatively adjustable with respect to the supporting component along at least opposite first and second vertical directions;

wherein the supporting component is provided with a rearward connecting component configured for receiving a corresponding adjustment fastener extendable through the intermediate component and into the rearward connecting component, in order to selectively adjust a positioning of the intermediate component with respect to the supporting component along the opposite first and second horizontal directions via a corresponding rotation of said adjustment fastener.

10. A hinge mechanism according to claim 9, wherein the rearward connecting component is provided on a rearward side of the supporting component; wherein the rearward side of the supporting component is operatively connected to at least one other side of the supporting component by at least one structural reinforcement component; wherein the rearward connecting component comprises a threading complementary to threading of the adjustment fastener; wherein the rearward connecting component comprises a threaded bolt mountable onto a corresponding portion of the supporting component; wherein the rearward connecting component is accessible by a corresponding side slot of the supporting component; wherein the main body of the intermediate component comprises a bore being positioned, shaped and sized for receiving the adjustment fastener; and wherein an inlet of the bore comprises a recessed portion for receiving a corresponding head of the adjustment fastener.

11. A hinge mechanism according to claim 1, wherein the main body of the intermediate component is shaped and sized for inserting into the main body of the supporting component.

12. A hinge mechanism according to claim 1, wherein the intermediate component defines a female hinging portion configured for receiving a corresponding male hinging portion of the swivelling component.

13. A hinge mechanism according to claim 1, wherein the swivelling component defines a female hinging portion configured for receiving a corresponding male hinging portion of the intermediate component.

14. A hinge mechanism according to claim 1, wherein the swivelling component defines a female hinging portion between a pair of distal hinging portions of one component of the hinge mechanism and is configured for receiving a central hinging portion of another component of the hinge mechanism; and wherein the hinging portions are connectable to one another by the pivot rod insertable through said hinging portions.

15. A hinge mechanism according to claim 1, wherein the swivelling component comprises a mounting plate configured for operatively mounting the swivelling component onto the second object via said mounting plate.

16. A hinge mechanism according to claim 15, wherein the mounting plate is provided with at least one hooking component for hooking the mounting plate and associated swivelling component onto the second object via said mounting plate; wherein the mounting plate is configured for adjustable mounting and positioning onto a main body of the swivelling component, and is operatively moveable with respect to said main body of the swivelling component for allowing a positional adjustment of the first object with respect of the second object by the hinge mechanism; wherein a vertical positional adjustment of the mounting plate with respect to the main body of the swivelling component is done by rotation of a pivoting component operatively mounted onto the main body of the swivelling component and having an eccentrically mounted pin cooperating with the mounting plate; wherein the mounting plate is adjustably movable within a corresponding recess defined about the main body of the swivelling component; wherein a side of the recess defined about the main body of the swivelling component is provided with at least one abutting component for abutting against the mounting plate; wherein the mounting plate is located on one side of the main body of the swivelling component, and is operatively connectable to an adjustment plate on an opposite side of the main body of the swivelling component by at least one positioning fastener; wherein the at least one positioning fastener comprises at least two positioning fasteners insertable into corresponding orifices of the main body of the swivelling component; wherein the at least one positioning fastener comprises at least three positioning fasteners, a first positioning fastener being insertable into a corresponding upper orifice of the main body of the swivelling component, a second positioning fastener being insertable into a corresponding lower orifice of the main body of the swivelling component, and a third positioning fastener being insertable into a corresponding central orifice of the main body of the swivelling component; wherein the adjustment plate includes a slot for allowing space for a corresponding head of an adjustment fastener of the hinge mechanism when the hinge mechanism is operated in a closed configuration; wherein the main body of the swivelling component includes a complementary cavity adjacent to the slot of the adjustment plate for further allowing space for the head of the adjustment fastener of the hinge mechanism when the hinge mechanism is operated in the closed configuration; and wherein the mounting plate comprises an orifice adjacent to the complementary cavity of the main body of the swivelling component for receiving a corresponding securing fastener.

17. A hinge mechanism according to claim 1, wherein the first object includes a main body frame of a storage space and wherein the second object includes a door of said storage space.

18. An adjustable hinge mechanism for providing a hinging movement between first and second objects, the hinge mechanism comprising:

a supporting component having a main body being operatively mountable onto the first object;

an intermediate component having a main body being operatively mountable onto the first object and being rotatably connected with a pivot rod and moveable with respect to the supporting component along at least opposite first and second horizontal directions; wherein the supporting component comprises at least one connecting component configured for receiving a corresponding tightening fastener extendable through opposite walls of the connecting component and through the intermediate component, to clamp the intermediate component between said opposite walls, thereby adjustably securing horizontal positioning of said intermediate component with respect to the supporting component; and a swivelling component being operatively mountable onto both the intermediate component and the second object, and being operatively adjustable with respect to the supporting component along at least opposite first and second vertical directions;

wherein the swivelling component comprises a mounting plate configured for operatively mounting the swivelling component onto the second object via said mounting plate wherein a plate of the swivelling component is provided with at least one connecting component for receiving therein a corresponding positioning fastener; wherein each connecting component of the swivelling component is provided on a same side of the main body of swivelling component; wherein each connecting component of the swivelling component comprises threading complementary to threading of a corresponding positioning fastener; wherein each connecting component of the swivelling component comprises a threaded bolt mountable onto a corresponding groove of the swivelling component; wherein another plate of the swivelling component is provided with a corresponding orifice for each orifice provided on the main body of the swivelling component; and wherein each orifice of the swivelling component is an oblong orifice.

* * * * *